US008407821B2

(12) United States Patent
Chan

(10) Patent No.: US 8,407,821 B2
(45) Date of Patent: Apr. 2, 2013

(54) INTELLIGENT FLUSHING SYSTEM

(76) Inventor: Mark Kit Jiun Chan, Hong Kong (HK)

( * ) Notice: Subject to any disclaimer, the term of this patent is extended or adjusted under 35 U.S.C. 154(b) by 379 days.

(21) Appl. No.: 12/610,274

(22) Filed: Oct. 31, 2009

(65) Prior Publication Data

US 2010/0146691 A1 Jun. 17, 2010

Related U.S. Application Data

(60) Provisional application No. 61/110,005, filed on Oct. 31, 2008.

(51) Int. Cl.
*E03D 5/10* (2006.01)

(52) U.S. Cl. ..... 4/406

(58) Field of Classification Search ..... 4/300, 313–314, 4/353–419, DIG. 3; 137/132, 240, 409; D23/295, D23/106
See application file for complete search history.

(56) References Cited

U.S. PATENT DOCUMENTS 5,333,276 A * 7/1994 Solari ..... 712/220
5,801,297 A * 9/1998 Mifsud et al. ..... 73/23.34
6,411,905 B1 * 6/2002 Guoliang et al. ..... 702/23
6,494,077 B2 * 12/2002 Aoyama et al. ..... 73/23.34
7,062,385 B2 * 6/2006 White et al. ..... 702/23
7,156,363 B2 * 1/2007 Parsons et al. ..... 251/30.04
7,359,802 B1 * 4/2008 Lewis et al. ..... 702/24
7,477,993 B2 * 1/2009 Sunshine et al. ..... 702/22
8,042,202 B2 * 10/2011 Parsons et al. ..... 4/623

FOREIGN PATENT DOCUMENTS

DE 10222193 A1 11/2003
DE 10222193 A1 * 11/2003
EP 1378612 B1 * 7/2002

OTHER PUBLICATIONS

PCT Search Report WO 2010/049913 Published May 6, 2010.

* cited by examiner

*Primary Examiner* — Lori Baker
(74) *Attorney, Agent, or Firm* — Ella Cheong Hong Kong; Sam T. Yip

(57) ABSTRACT

An intelligent flushing system uses odor sensors and cameras to monitor interior conditions of a plumbing product and detect wastes. Recognition of need to activate a flush mechanism is determined by a control unit in accordance with conditions and wastes detected through processed sensor data and camera captured images. Water conservation is achieved by performing diagnostic and preinstalled flush procedures with controlled flush volumes. Flush performance assessment results and related data are stored in a database for statistical analysis and fine-tuning computation for continuous operation betterment. An apparatus with control methods coordinate data and signal processing, flush activation, data storage and communication. All processed information may be transported between various individually operable intelligent flushing systems, information systems of the user, supplier and others via network connection.

19 Claims, 8 Drawing Sheets

INTELLIGENT FLUSHING SYSTEM

BACKGROUND OF THE INVENTION

Field of the Invention

The present invention relates to an intelligent flushing system and a control method, more particularly through use of odor sensors and cameras to maintain a plumbing product at preferable conditions. Information on use and operability of the intelligent flushing system may be stored and obtained by user of the intelligent flushing system (building management), supplier (provider of the intelligent flushing system) and other parties.

SUMMARY OF THE INVENTION

A prime object of the present invention is to provide an intelligent flushing system and control method thereof, wherein the intelligent flushing system monitors a plumbing product and identifies nature of litter and wastes via detection of malodor and analysis of captured images. To achieve water conservation, the intelligent flushing system selects among diagnostic and preinstalled flush procedures with minimal flush volume in accordance with processed data. Wherein, a plumbing product typically denotes:

a) urinal;

b) flush toilet;

c) squat toilet.

In the disclosed embodiment of this invention, a control method employs digital signal processing technology to analyze camera captured images of monitored areas in a plumbing product. Captured images of preferable conditions of a plumbing product are stored and compared against real-time images of a plumbing product for wastes detection. Whereas, cleanliness of a camera is maintained with a setup encompassing protective lens and self-cleansing functionality. A pressurized water jet is used to keep contaminated fluid from blotting or staining the protective lens, which may cause distortions in captured images.

The use of digital signal processing of real-time images captured by a camera provides an analysis of plumbing product conditions and detection of liquid and solid wastes by nature and dimensions. Required component comprise:

(a) cameras (ccd—charged couple device, cmos—complementary metal oxide-semiconductor), or other optical sensors, spectral sensors and image capture devices/systems, embedded in a plumbing product, toilet seat, partition, ceiling or the vicinity, that are coupled to a control unit, to capture optical conditions of a plumbing product;

b) 2D image processing, comprising background subtraction, filtering, object segmentation, Fourier Transforms and compression, identification of wastes nature and dimensions, is used for selection of a corresponding flush procedure;

c) 3D modeling method using 'seed fill algorithm', face/object recognition or other technology, requires multiple cameras to capture an image from different views for construction of 3D model of wastes and computation of dimensions. Objects of 2D image processing and 3D modeling in this invention include selection of a flush procedure, and computation of required flush volume in a flush mechanism.

Digital signal processing of real-time images allows prevention of premature flushing and overflow. Sufficient time is made availed for the patron to leave the vicinity of a plumbing product before a flush mechanism is activated. On the other hand, water flow is terminated if overflow in a plumbing product during a flush mechanism process is reflected by real-time images.

The use of cameras and digital signal processing technology also enables assessment on performance of a primary flush mechanism by comparing images of posterior optical conditions of a plumbing product with imagery reference. The control unit analyzes the comparison and determines on the need to activate a posterior flush mechanism with a selected flush procedure.

Sufficient water pressure in each flush activation is assured by prohibiting simultaneous activations of two or more flush mechanisms. The intelligent flushing system comprises a water supply pipeline apparatus comprising valves with various flow timing. In case the control unit determines a need for flushing several plumbing products, the corresponding valves are sequentially actuated for activation of one flush mechanism at a time.

Another object of the present invention is to provide an information based intelligent flushing system. Effective digital data transmission between various intelligent flushing systems and other information systems is performed through a network link, which comprises a combination of fixed-line and/or wireless links in the network.

An information based intelligent flushing system is capable of sending alert and perform self-diagnosis. Given the optical conditions of a plumbing product seem unsatisfactory after a few consecutive flushes, the intelligent flushing system halts further flush activation and sends an alert to building management for an attended inspection. And, an alert is sent when a defunct component or deficient operation is detected within the intelligent flushing system. Self-diagnosis is performed for ascertainment of functionalities of components during normal operation, and inspection for roots of cause when irregularities arise. Results including identified cause of problem and a list suggesting defunct components for replacement may be created, which are sent to building management, the supplier and/or other parties.

DETAILED DESCRIPTION OF THE PREFERRED EMBODIMENTS

Intelligent flushing system 02 of the present invention monitors conditions of a plumbing product and activates flush mechanism in accordance with actual needs; it uses minimal flush volume and power consumption while at the same time alerts building management for attended care. The present invention may be readily understood with reference to FIG. 1-FIG. 8, and better appreciated using depicted exemplary embodiments in specific context.

Figure 1A:
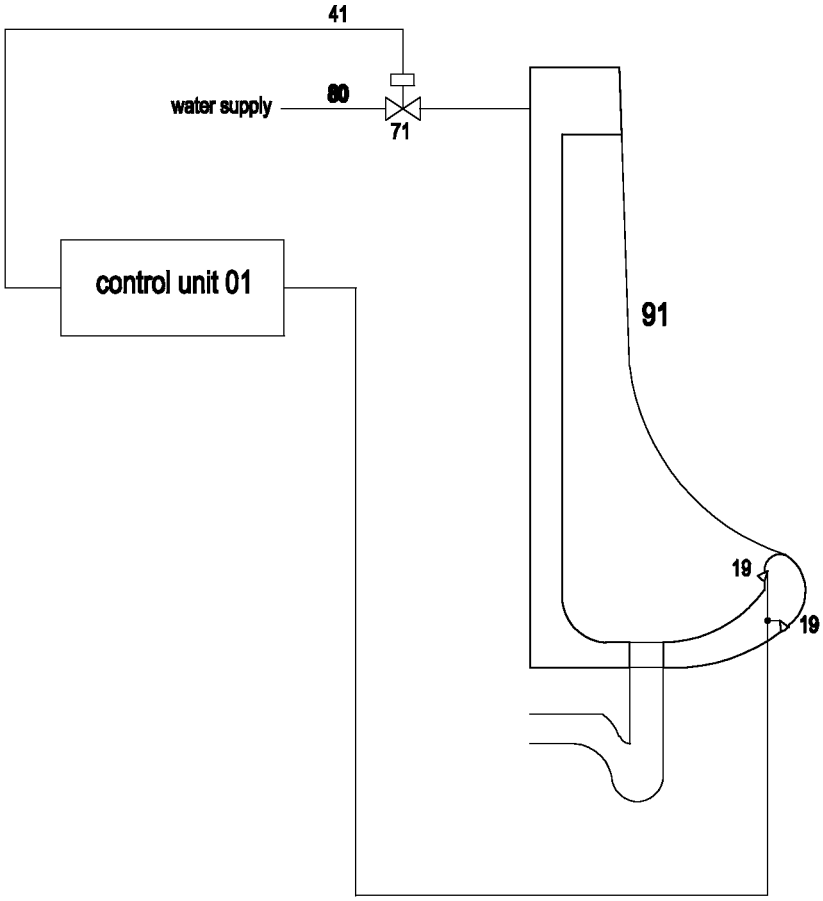
FIG. 1A is a schematic diagram of a urinal controlled by an intelligent flushing system of the present invention.
Figures 1B, 1C:
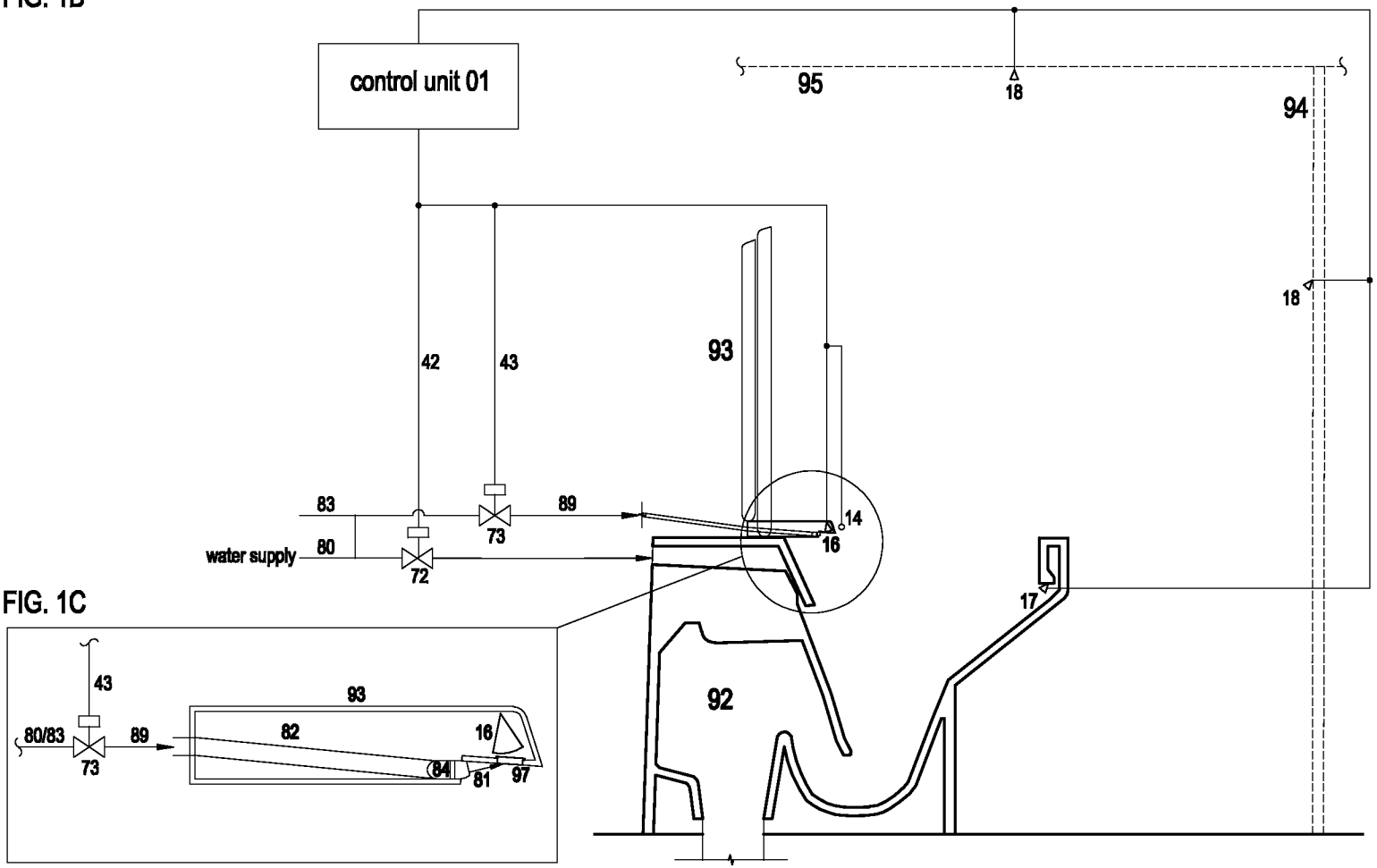
FIG. 1B is a schematic diagram of a toilet controlled by an intelligent flushing system of the present invention.
FIG. 1C is a schematic diagram depicting a nozzle for cleansing the protective lens of a camera in a toilet.

Referring to FIG. 1A, camera 19 embedded in urinal 91 and valve 71, are connected to control unit 01. A command 41 is sent by control unit 01 to actuate valve 71 to open for flush activation and close at completion. In FIG. 1B, odor sensor 14, camera 16 and camera 17 embedded in toilet seat 93 and toilet 92, cameras 18 embedded in partition 94 and ceiling 95, valve 72 are connected to control unit 01. A command 42 is sent by control unit 01 to actuate valve 72 to open for flush activation and close at completion.

As shown in FIG. 1C, a protective lens 97, preventing contaminated toilet fluid from blotting and staining camera 16, is embedded within toilet seat 93. A nozzle 84 is attached to a hollow channel 82 located under toilet seat 93. While control unit 01 determines to cleanse protective lens 97, a command 43 is sent to valve 73, which discharges a pressurized fluid 89 and renders a cleansing jet 81 to squirt through nozzle 84 onto protective lens 97. The pressurized fluid 89 may be connected to the water supply through a water supply pipeline 80, and/or liquid detergent line 83.

Figure 1D:
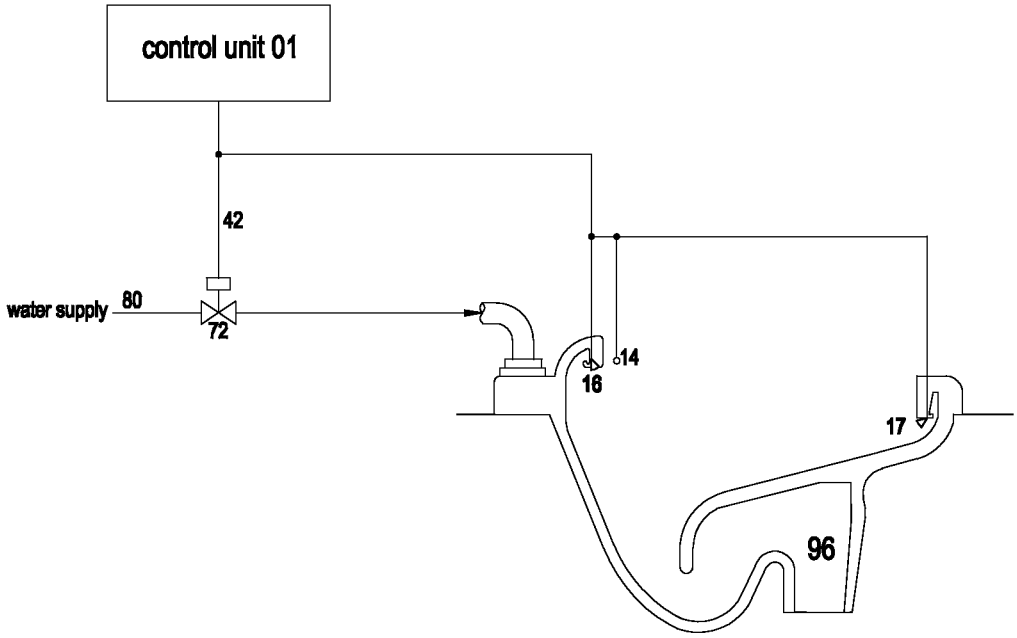
FIG. 1D is a schematic diagram of a squat toilet controlled by an intelligent flushing system of the present invention.

Referring to FIG. 1D, odor sensor 14, camera 16 and camera 17 provide data of the conditions of squat toilet 96 to control unit 01. Upon determination of control unit 01 for activation of a flush mechanism, a command 42 is sent to actuate valve 72 to open for flush activation and close at completion.

Figure 1E:
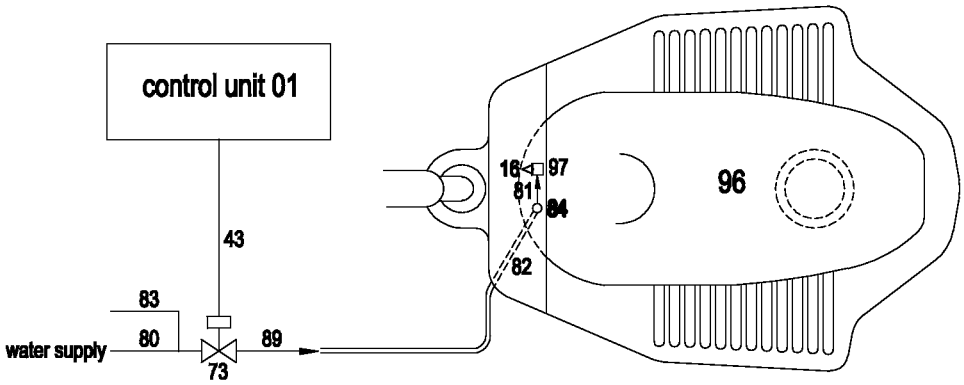
FIG. 1E is a schematic diagram depicting a nozzle for cleansing the protective lens of a camera in a squat toilet.

Referring to FIG. 1E, a protective lens 97 shields camera 16 in a squat toilet 96 from contaminated toilet fluid. In a lens cleansing process, a command 43 is sent by control unit 01 to actuate valve 73 for discharge of a pressurized fluid 89 from a water supply pipeline 80, and/or liquid detergent line 83, into a hollow channel 82. A cleansing jet 81 is squirted from nozzle 84 to protective lens 97 of camera 16.

Figure 2:
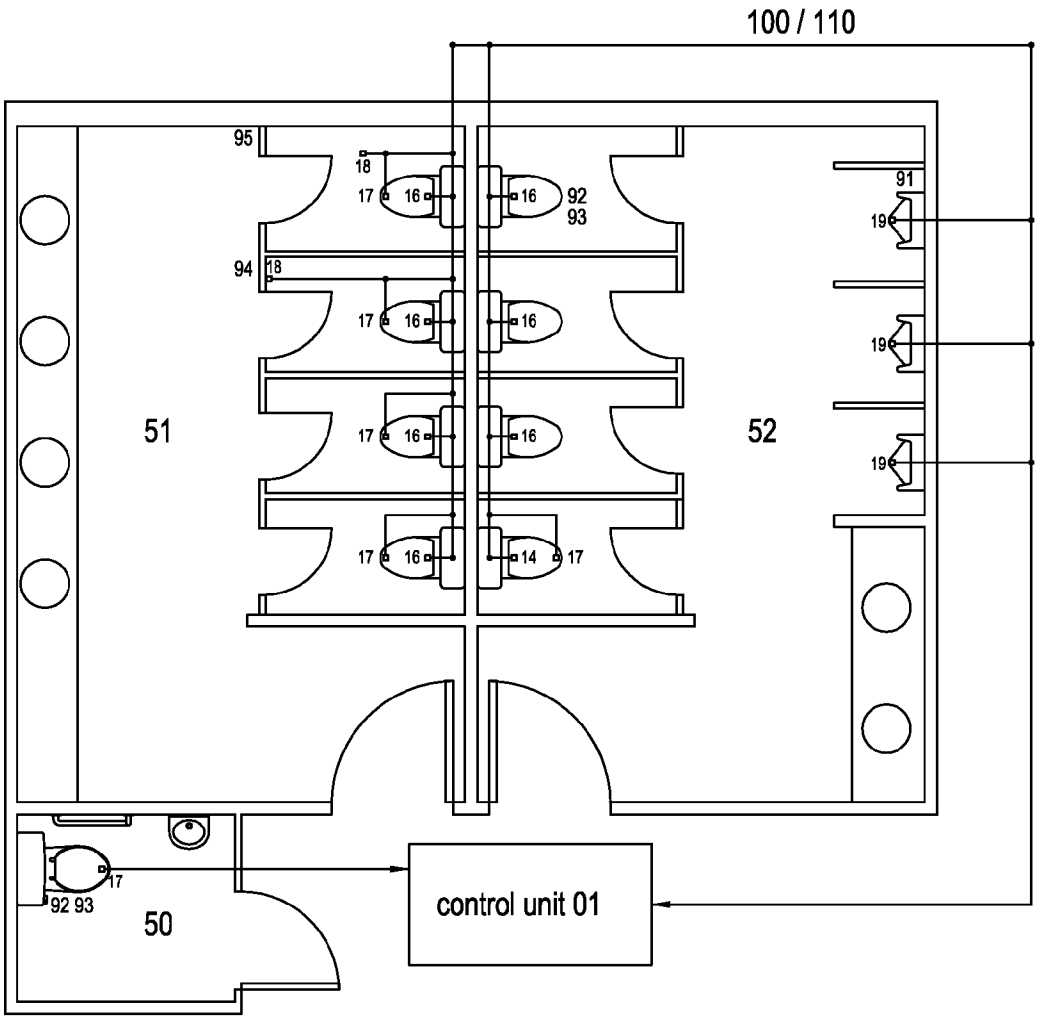
FIG. 2 is an exemplary diagram of a commercial washroom plan equipped with an intelligent flushing system of the present invention.

As depicted in FIG. 2, an exemplary washroom plan comprises a Handicap's Room 50, Lady's Room 51 and Men's Room 52. Urinal 91 is embedded with a camera 19; whereas, toilet 92 and toilet seat 93 are embedded with an odor sensor 14, cameras 16 and/or 17; partition 94 and ceiling 95 are embedded with camera 18. Images captured by cameras 16, 17, 18 and 19 are sent via I/O (input/output) bus 100 to control unit 01 and processed. Bus 110 transmits commands 41, 42 and 43 from control unit 01 for actuation of valves 71, 72 and 73 (not shown).

Figure 3:
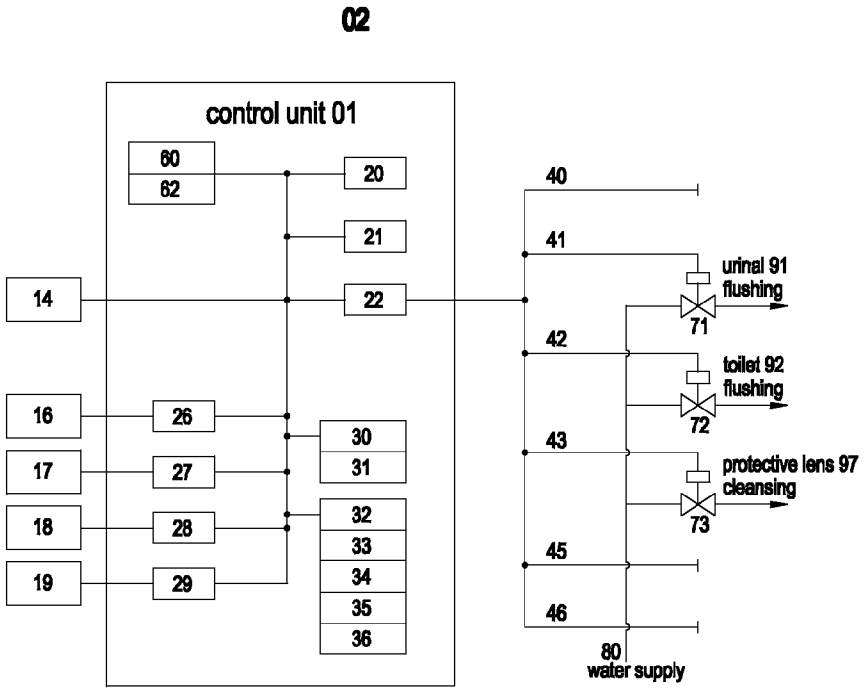
FIG. 3 is a schematic diagram of an exemplary intelligent flushing system of the preferred embodiment of FIG. 1A, FIG. 1B, FIG. 1C, FIG. 1D and FIG. 1E.

FIG. 3 depicts a preferred embodiment of an exemplary intelligent flushing system 02 comprising control unit 01, which is a stand-alone, multicore platform module. Control unit 01 is centered around a plurality of components, comprising GP (general-purpose) processor 20, on-board memory 21, general purpose input/output (GPIO) 22, odor sensor 14, cameras 16, 17, 18, 19 coupled with a corresponding dsp (digital signal processor) 26, 27, 28, 29, respectively, as well as valves 71, 72 and 73. In use with cameras 16-19, optical images of a plumbing product bowl area are continually captured at 10 to 40 fps (frame per second), and sent via I/O bus 100 for processing by the corresponding dsp 26, 27, 28, 29 in control unit 01. Selected images capturing preferable optical conditions of a plumbing product may be stored as imagery references in on-board memory 21 and/or external memory 23 (not shown) with user specified/periodic renewal.

When intelligent flushing system 02 operates in automatic mode 31, GP processor 20 handles tasks including processing signals of odor sensor 14, data storage and archiving, network communication; dsp 26-29 process data from cameras 16-19 and send commands 41, 42, 43 through I/O bus 110 to valves 71, 72 and 73 for activation of flush mechanism. On the other hand, a flush mechanism may be manually activated in manual mode 30 by pressing an overriding switch (not shown). Wherein multicore-enabled control unit 01 is preinstalled with operating system 60 and 3D model generation module 62, it may also employ heterogeneous architectures with multiple dimensions in computing components, such as processors, operating systems, interconnects, memories and programming languages. In other embodiments, GP processor 20 and dsp 26-29 may be substituted by other processors, including but not limited to central processing units (CPU), field programmable gate arrays (FPGA), microcontroller units (MCU) and application specific integrated circuits (ASIC), etc.

Info 45 comprising data such as time, date, temperature, other real-time and archival information regarding use of a washroom from clocks, room and outdoor temperatures, motion sensor signals, as well as, external information sources, etc. is fed to control unit 01. The supplementary information providing cross reference with records of use in plumbing products of a washroom, is used for computation of probabilities in immediate use of a urinal and therefore selection of a flush procedure with minimal flush volume. Probabilities in use of washroom may also be used by the intelligent flushing system 02 for determination of entering divisional or total power-save mode when lower-usage or vacant periods are anticipated.

Info 46 comprises operational information of intelligent flushing system 02, including signals of odor sensor 14, images captured by cameras 16-19, imagery reference, frequency of use with selection and performance of preinstalled flush procedures 32-35, diagnostic flush procedure 36, alert 40, computed flush volumes versus wastes dimensions with flush performance assessment results, total water and power consumption, selection between manual mode 30 and auto mode 31, and results of self-diagnosis, etc. Wherein info 46 is stored in on-board memory 21 and/or external memory 23—through network link 200 and interconnect 120-5 (see FIG. 6)—for fine-tuning in flush procedure selection and flush volume computation to serve self-learning purposes. Recorded data is also used for real-time presentation, statistical analysis and archiving purposes.

Control unit 01 is preinstalled with several flush procedures by building management, supplier and/or other authorized parties. Five exemplary flush procedures include:

TABLE 1

| procedure | application | plumbing product | flush volume | valve opening |
|---|---|---|---|---|
| 32 | liquid waste | toilet | smaller | 12 seconds |
| 33 | solid waste | toilet | larger | 16 seconds |
| 34 | rinse | urinal | smaller | 4 seconds |
| 35 | regular | urinal | larger | 8 seconds |
| 36 | litter/solid | toilet | customized | variable |

The control unit 01 sends commands 41 and 42 for actuation of valves 71 and 72 when litter, liquid or solid wastes in a plumbing product are detected through real-time images or odor sensor signals, or captured images indicate deviation in plumbing product conditions in comparison to the preferable conditions in imagery reference.

Liquid waste flush procedure 32 is detailed as follows:

1. control unit 01 sends command 42 to open valve 72 for 12 seconds to discharge water and drain out liquid waste or scanty litter through the trapway and rinse the inner surface of a toilet;
2. terminate flush flow by closing valve 72;
3. upon completion of primary flush, images of toilet 92 conditions are captured by camera 16 and/or camera 17 and/or camera 18 and sent to control unit 01 for flush performance assessment;
4. unsatisfactory assessment results of primary flush lead to a secondary performance of flush procedure 32, 33 or diagnostic flush procedure 36 in accordance with image identified conditions of toilet 92;
5. repeat steps 3 and 4 until conditions of toilet 92 are satisfactory, or number of flush activations reaches a preset limit;
6. send alert 40 in case number of flush activations reaches a preset limit.

Solid waste flush procedure 33 is detailed as follows:

1. control unit 01 sends command 42 to open valve 72 for 16 seconds to discharge water and drain out solid wastes through the trapway and rinse the inner surface of a toilet;
2. terminate flush flow by closing valve 72;
3. upon completion of primary flush, images of toilet 92 conditions are captured by camera 16 and/or camera 17 and/or camera 18 and sent to control unit 01 for flush performance assessment;
4. unsatisfactory assessment results of primary flush lead to a secondary performance of flush procedure 32, 33 or diagnostic flush procedure 36 in accordance with image identified conditions of toilet 92;
5. repeat steps 3 and 4 until conditions of toilet 92 are satisfactory, or number of flush activations reaches a preset limit;
6. send alert 40 in case number of flush activations reaches a preset limit.

Rinse flush procedure 34 is detailed as follows:

1. control unit 01 sends command 41 to open valve 71 for 4 seconds to discharge water with a smaller volume to rinse of the inner surface of a urinal;
2. terminate flush by closing valve 71;
3. upon completion of primary flush, images of urinal 91 conditions are captured by camera 19 and sent to control unit 01 for flush performance assessment;
4. unsatisfactory assessment results of primary flush lead to a secondary performance of flush procedure 34 or 35 in accordance with image identified urinal 91 conditions;
5. repeat steps 3 and 4 until conditions of urinal 91 are satisfactory, or number of flush activations reaches a preset limit;
6. send alert 40 in case number of flush activations reaches a preset limit.

Regular flush procedure 35 is detailed as follows:

1. control unit 01 sends command 41 to open valve 71 for 8 seconds to discharge water with a larger volume to rinse the inner surface of a urinal;
2. terminate flush by closing valve 71;
3. upon completion of primary flush, images of urinal 91 conditions are captured by camera 19 and sent to control unit 01 for flush performance assessment;
4. unsatisfactory assessment results of primary flush lead to a secondary performance of flush procedure 34 or 35 in accordance with image identified urinal 91 conditions;
5. repeat steps 3 and 4 until conditions of urinal 91 are satisfactory, or number of flush activations reaches a preset limit;
6. send alert 40 in case number of flush activations reaches a preset limit.

Referring to FIG. 3, intelligent flushing system 02 uses odor sensor 14 and cameras 16-19 to detect litter and wastes, and monitor plumbing product conditions in order to maintain preferable conditions. Exemplary flush mechanism activations is demonstrated in Table 2:

TABLE 2

| Mechanism | Component | Use | Object of Detection | Time of Realization | Time of Flush |
|---|---|---|---|---|---|
| 1. | camera 19 | urinal | optical conditions | 6 to 8 sec. | 4-8 sec. |
| 2. | camera 16, 17, 18 | toilet | optical conditions | 6 to 8 sec. | 12-16 sec. |
| 3. | odor sensor 14 | toilet | malodor | 6 to 8 sec. | 12-16 sec. |

Mechanism 1: When real-time images captured by camera 19 comparing with imagery reference indicate an abrupt loss in light intensity, a fluid stream or stain, etc. in urinal 91, control unit 01 selects between rinse flush procedure 34 and regular flush procedure 35;

(a) when control unit 01 concludes with a considerable probability in immediate use of urinal 91 by a patron in accordance with info 45, control unit 01 performs rinse flush procedure 34 within 6 to 8 seconds upon redemption of light or when real-time images indicate that use of urinal 91 is finished;

(b) when control unit 01 concludes with a low probability in subsequent use of urinal 91 by a patron within a default time period in accordance with info 45, control unit 01 performs regular flush procedure 35 within 6 to 8 seconds upon redemption of light or when real-time images indicate that use of urinal 91 is finished;

(c) when real-time images captured by camera 19 comparing with imagery reference indicate stain in urinal 91 remains for more than 60 seconds after the performance of rinse flush procedure 34 and at the same time, and control unit 01 concludes that there is a low probability in subsequent use of urinal 91 by a patron within a default time period in accordance with info 45, control unit 01 performs regular flush procedure 35.

Mechanism 2:

(a) when real-time images captured by cameras 16, 17 or 18 compared with imagery reference indicate a liquid stream, light color change of water, a light load of toilet paper, other scanty litter/wastes and/or an abrupt loss in light intensity in toilet 92, 2D image processing is used for recognition of wastes; control unit 01 performs liquid waste flush procedure 32 within 6 to 8 seconds upon redemption of light or when captured images become unchanging;

(b) when real-time images captured by cameras 16, 17 or 18 compared with imagery reference indicate a significant color change of water and accumulation of solid wastes in toilet 92, and/or an abrupt loss in light intensity, 2D image processing is used for estimation of dimensions of wastes, control unit 01 performs solid waste flush procedure 33 within 6 to 8 seconds upon redemption of light intensity;

(c) when real-time images captured by cameras 16 and/or 17 compared with imagery reference indicate an accumulation of solid wastes in toilet 92, and/or an abrupt loss in light intensity, a 3D model of the solid wastes is constructed with 3D model generation module 62, volumetric dimensions of wastes are estimated and used to compute the required flush volume for performance of diagnostic flush procedure 36 within 6 to 8 seconds upon redemption of light intensity.

Mechanism 3: When real-time images captured by cameras 16, 17 or 18 compared with imagery reference indicate an abrupt loss in light intensity in toilet 92 and odor sensor 14 recognizes a malodor, control unit 01 performs solid waste flush procedure 33 within 6 to 8 seconds upon redemption of light in toilet 92.

Physical detachment of patron from toilet 92 may be assured before flushing as use is completed providing captured images indicate that light loss in toilet 92 is regained. During any moment of a flush mechanism process, should an overflow in urinal 91 or toilet 92 be detected by images captured by cameras 16-19, water flow is immediately terminated through closing valves 71 and 72.

An alert 40 is generated by a control unit 01 when:

(a) control unit 01 sends out commands 41, 42, 43 but one or more of valves 71, 72 and 73 do not respond;

(b) real-time images of urinal 91 or toilet 92 captured by cameras 16-19 indicate that optical conditions remain unchanged upon completion of flush mechanism activation;

(c) number of consecutive flush activations resulted from unsatisfactory assessment results of flush performances reaches a preset limit;

(d) a defunct component or deficient operation is detected within intelligent flushing system 02;

(e) control unit 01 terminates a flush mechanism due to an oncoming overflow in a urinal 91 or toilet 92 as indicated in images captured by cameras 16-19.

The intelligent flushing system 02 operates in an auto mode 31 by default. When alert 40 is sent to one or more destinations for recommendation of inspection of a plumbing product and/or the intelligent flushing system 02, control unit 01 halts flush mechanism automation of a plumbing product and switches the default auto mode 31 to a temporary manual mode 30. Auto mode 31 may be manually restored through an authorized entry to control unit 01 or automatically restored as control unit 01 is able to administer normal operation in intelligent flushing system 02. A manual overriding switch (not shown) is also made available to allow a patron to select manual mode 30 over an automatic mode 31 for patron benefits.

Figure 4:
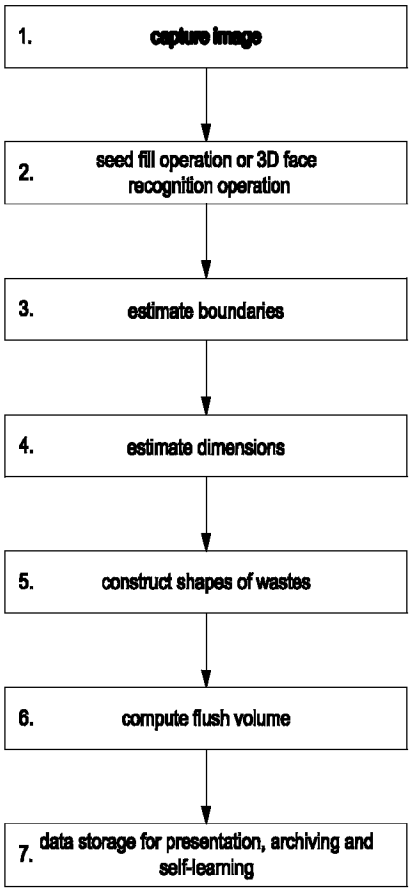
FIG. 4 is a flow diagram of an exemplary 3D model generation method.

Referring to FIG. 3, control unit 01 comprises a 3D model generation module 62 that automatically generates a 3D model of objects in a captured image. FIG. 4 is an exemplary flow chart depicting the 3D model generation process. In step 1, images captured by 2 or more cameras are loaded to on-board memory 21 or external memory 23. Alignment of the top down view is performed (step 2) on the image to eliminate the variable background, define boundaries of wastes and estimate dimensions of occluded sections. To locate landmark points on an image, a 'seed fill' operation or 3D face reconstruction begins once the colors and shapes of different objects have been identified, while bounds of wastes are limited by using dimensions of the plumbing product in step 3. Proceeding to step 4, dimensions of wastes may be estimated by performing statistical linear integration of a field of pixels, and/or analyzing the statistical properties of different wastes in a database stored in on-board memory 21 and/or external memory 23. In step 5, a 3D model comprising complete shapes of objects can be reconstructed. In step 6, estimated volumetric dimensions of wastes may be used for computation of the required flush volume in a diagnostic flush procedure 36, or selection between preinstalled flush procedures 32 and 33. Resulting data of 3D model construction used in activation of a flush mechanism is saved in on-board memory 21 and/or external memory 23 along with corresponding flush procedure/computed flush volume and flush performance assessment results in step 7 for statistical analysis and computation refinement in ongoing computations.

The 3D modeling method performs a series of image processing techniques to determine a set of landmark points which serve as guides for generating 3D model of solid wastes. Steps in FIG. 4 are used in step 530 of process 500 when control unit 01 selects diagnostic flush procedure 36 and a 3D model is used for activation of a flush mechanism.

Figure 5A:
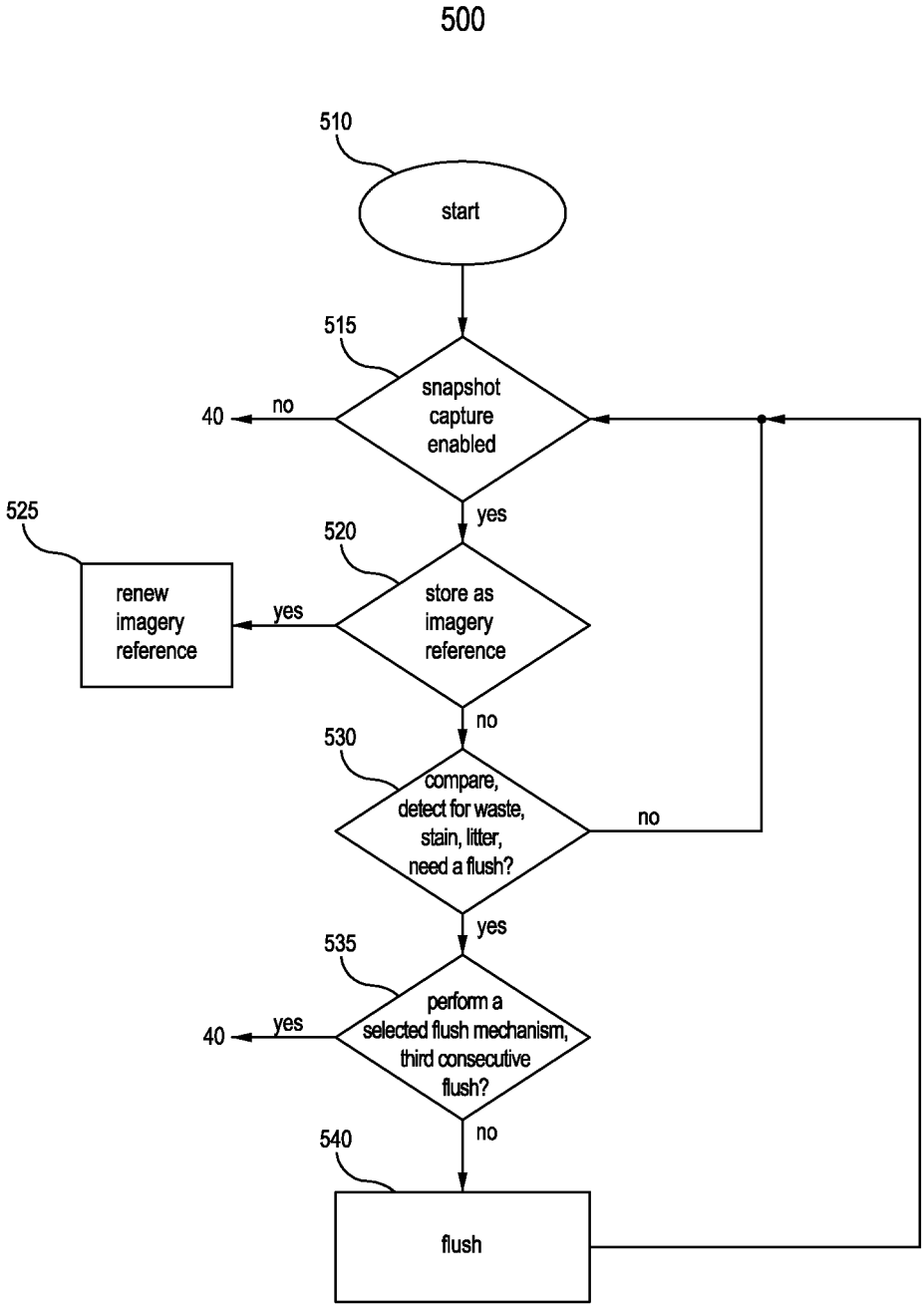
FIG. 5A is a flow diagram illustrating portions of the control method of the present invention in a toilet application, using digital image processing technology in 2D image processing and 3D modeling.

As depicted in FIG. 5A, one control method used in intelligent flushing system 02 is process 500. Real-time images captured from toilet 92 in washroom 50, 51 and 52 are processed for determination of flush mechanism activation. Process 500 commences in step 510 when control unit 01 realizes a considerable probability in immediate use of toilet 92 in accordance with processed real-time captured images and/or info 45. A selected real-time image captured in step 515 during different times of the day, as per instructions preset by one or more authorized parties, of preferable toilet bowl conditions of toilet 92 is stored in step 520 as imagery reference, which is specifically/periodically renewed. In step 530, real-time images captured in step 515 are compared against imagery reference for differences in conditions, detection of stain, litter, and sizes of solid wastes, etc. Upon recognition of a need for flush, control unit 01 selects among flush procedures 32 and 33 in accordance with the nature of optical conditions of toilet 92. In performance of a diagnostic flush procedure 36, control unit 01 uses 3D model generation module 62 to create a 3D model for the solid wastes and computes the required flush volume for total wastes removal based on estimated dimensions. Process 500 proceeds to step 535, where a count is tracked for the number of consecutive flush activations due to unsatisfactory flush performance assessment results. If the number of consecutive flush activations has not exceeded a preset limit, process 500 proceeds to step 540 for activation of a flush mechanism. An alert 40 is sent to building management for inspection of intelligent flushing system 02 and/or toilet 92 if consecutive flush activations have exceeded a limit in step 535, or when images are not captured in step 515. 3D modeling steps in FIG. 4 are used in step 530 of process 500 when diagnostic flush procedure 36 is performed.

Figure 5B:
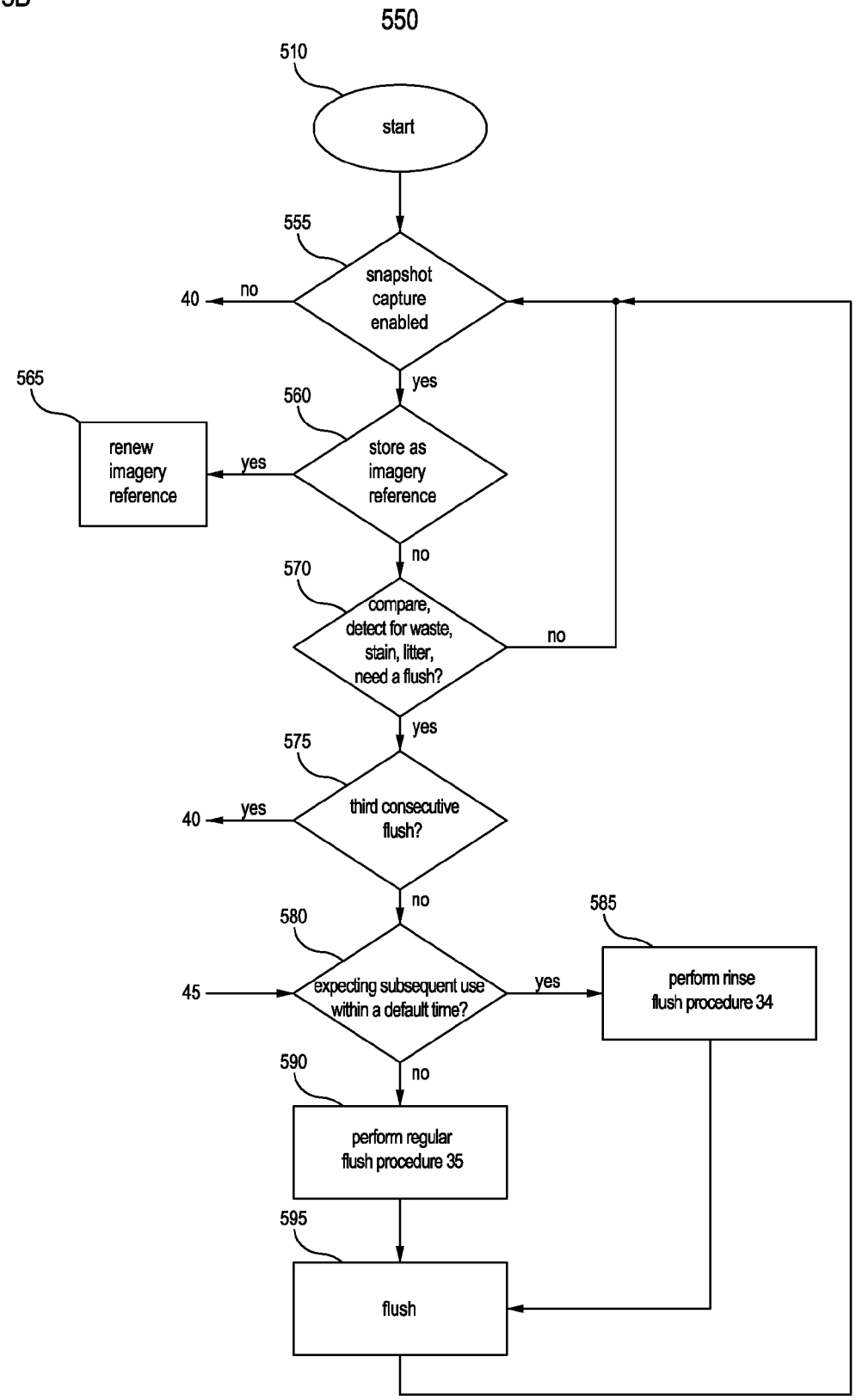
FIG. 5B is a flow diagram illustrating portions of the control method of the present invention in a urinal application using digital image processing technology in 2D image processing.

As depicted in FIG. 5B, intelligent flushing system 02 follows process 550 for flush activation of urinal 91 in washroom 52. When processed real-time images captured by camera 19 and/or info 45 indicate a considerable probability in immediate use of urinal 91, process 550 commences in step 510. Real-time images of urinal 91 are continuously captured in step 555; a captured image considered to indicate preferable conditions of urinal 91 is stored as imagery reference in step 560, which is specifically/periodically renewed in step 565. Real-time images are compared against imagery reference for detection of stain, fluid stream or litter, etc. Upon recognition of a need for flush in step 570, process 550 proceeds to step 575. If the number of consecutive flush activations has not exceeded a preset limit, control unit 01 selects between flush procedures 34 and 35 in step 580. With reference to info 45, if control unit 01 realizes that patrons are expected to use the urinal 91 within a default time period or washroom 52 is expecting imminent visitors, step 585 is selected for performance of rinse flush procedure 34. When info 45 indicates that washroom 52 is vacant or there is a low probability of following visitors approaching urinal 91 within a default time period, step 590 is selected for performance of regular flush procedure 35. After a flush mechanism has been activated in step 595, control unit 01 returns to step 555. An alert 40 is sent to building management for inspection of intelligent flushing system 02 if images are not captured in step 555 or the consecutive flush activations number has exceeded the limit in step 575.

Figure 6:
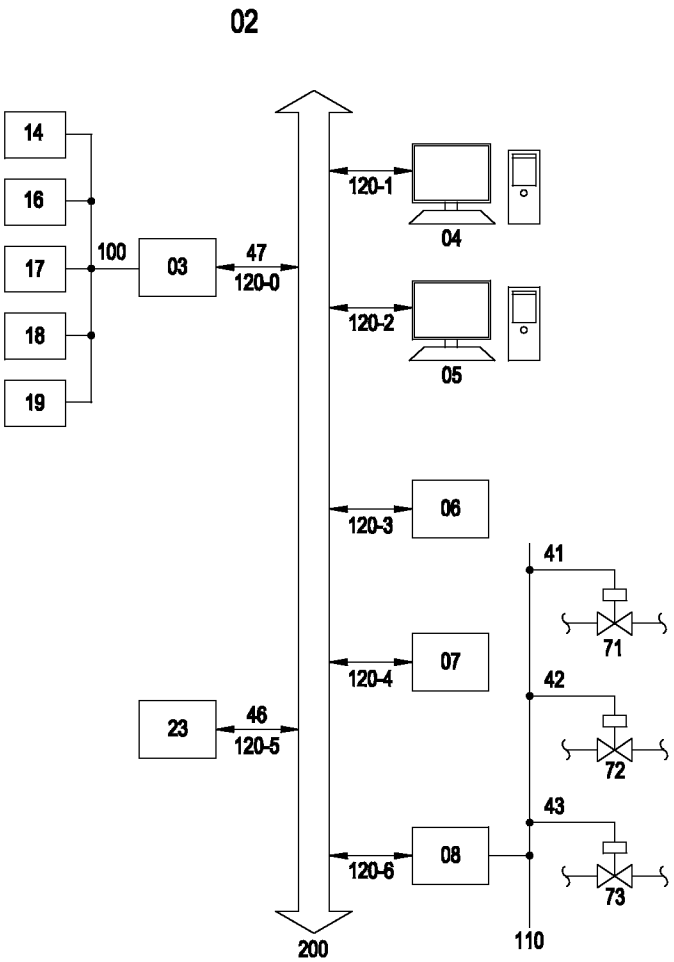
FIG. 6 depicts an exemplary control unit configuration of the intelligent flushing system, which is in form of a pc, server and simulated controller in Building Management System (BMS) as an alternative embodiment as shown in FIG. 3.

Alternate to a stand-alone module as shown in FIG. 3, control unit 01 may function in form of other structures. Additionally, intelligent flushing system 02 includes interfaces 03 and 08, I/O buses 100 and 110. Referring to FIG. 6, control unit 01 functions in form of an on-site PC station 04, an off-site server 05 and a simulated controller within a BMS 06. Wherein, interface 03 couples odor sensor 14, cameras 16-19 to network link 200 through interconnect 120-0. Data 47, comprising all captured sensor signals and data from odor sensor 14, cameras 16-19, is transported to on-site PC station 04, off-site server 05 or simulated controller within BMS 06 via corresponding interconnects 120-1, 120-2 and 120-3 for processing, real-time presentation, storage or distribution, etc. Through interconnect 120-5 and network link 200, info 46 stored in external memory 23 may be transported between on-site PC station 04, off-site server 05, simulated controller within BMS 06 and supplier server 07.

The supplier server 07, operated by the supplier, receives info 46 via interconnect 120-4 as authorized by building management. In recognition of a need for flush, control unit 01 sends commands 41, 42 or 43 to interface 08 through interconnect 120-6 and I/O bus 110 for activation of valves 71, 72 or 73. Network link 200 may comprise a combination of one or more conventional fixed-line or wireless networks, including but not limited to a LAN (Local Area Network), the Internet, an Intranet, etc. 'N' number of interconnects **120-*n* (where n=0-6), as well as network link 200, I/O buses 100 and 110**, may comprise a variety of communication media. Such communication media includes but not limited to coaxial wire, Ethernet cable, ISDN (Integrated Services Device Network) line, PSTN (Public Switch Telephone Network) line, fiber optic line and PLC (power line communication), etc. Wireless communication media in a network allows signals to be propagated in infrared and Radio Frequencies, ZigBee, Bluetooth, WiFi, WiMax, etc.

Figure 7:
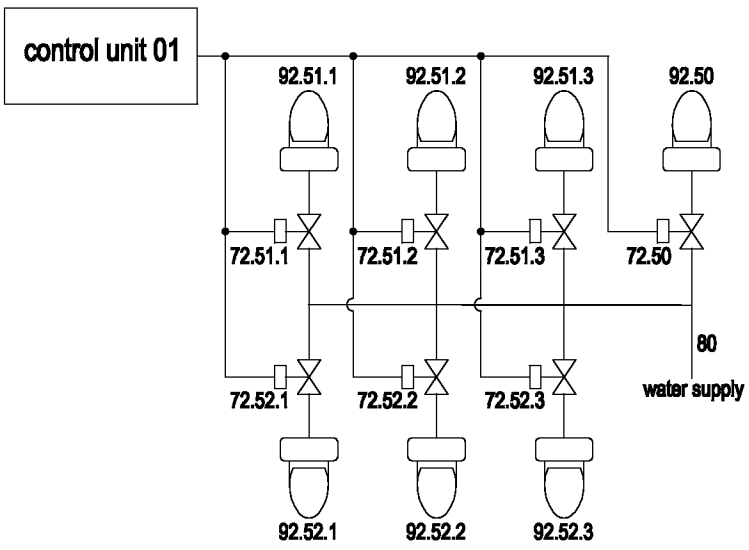
FIG. 7 is a schematic diagram of water supply pipeline setup connecting toilets to an intelligent flushing system of the present invention.

Referring to FIG. 7, a water supply pipeline 80 connects to several toilets controlled by intelligent flushing system 02 of the present invention. Water supply pipeline 80 supplies flush water through multiple aqueducts, each controlled by an individual valve: valve 71 controlling flush flow to a urinal, valve 72 controlling flush flow to a toilet, and valve 73 controlling cleansing jet to camera lens. The intelligent flushing system 02 assures sufficient water pressure in a flush by precluding simultaneous activations of two or more flush mechanisms at any time. In FIG. 7, toilets 92.51.1, 92.51.2, 92.51.3, 92.50, 92.52.1, 92.52.2, and 92.52.3 are shown. Valves 72.50, 72.51.1, 72.51.2, 72.51.3, 72.52.1, 72.52.2, and 72.52.3 are also shown. In an example that a need is recognized for flushing toilets 92.51.1, 92.52.1 and 92.50, control unit 01 sequentially actuates the corresponding valves for provision of sufficient water pressure in each flush:

1. control unit 01 establishes an exemplary order of priority for activation of flush mechanisms to toilets 92.51.1, 92.52.1 and 92.50;
2. performance of liquid waste flush procedure 32, solid waste flush procedure 33 and a diagnostic flush procedure 36 is required for toilets 92.51.1, 92.52.1 and 92.50, respectively;
3. control unit 01 sends out command 42 to open valve 72.51.1; upon completion of flush mechanism, valve 72.51.1 is closed;
4. control unit 01 sends out command 42 to open valve 72.52.1; upon completion of flush mechanism, valve 72.52.1 is closed;
5. control unit 01 sends out command 42 to open valve 72.50; upon completion of flush mechanism, valve 72.50 is closed.

Figure 8:
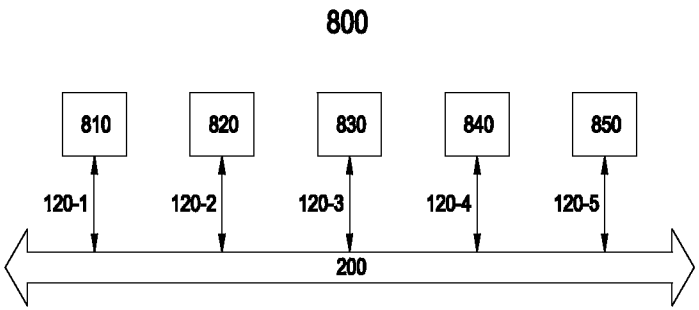
FIG. 8 is a schematic diagram of a network environment of control units of various intelligent flushing systems, a supplier server coupled with a shared-memory unit via a network link used in one embodiment of the present invention.

FIG. 8 illustrates a network environment used in one embodiment of the present invention. Network environment 800 includes multiple (n) nodes. Individually operable control units 01 functioning in form of on-site PC station 04, off-site server 05, simulated controller within BMS 06, along with supplier server 07 and external memory 23, are represented by nodes 810, 820, 830, 840 and 850, respectively. Nodes 810-850 are coupled together via a network link 200, which serves as a continuous open communication link between all nodes through interconnects 120-0 to 120-6. Archival, transmittal and obtainment of info 45 and info 46 of various intelligent flushing systems 02, as well as, other data, may be processed and sent among nodes 810-850 as instructed by building management, the supplier or other authorized parties. Via a network link 200, node 840 may renew specifications and computation methodologies, update software in nodes 810-830, including but not limited to processes 500 and 550, flush procedures 32-35, operating system 60, image processing algorithms and others. Network environment 800 provides a shared-memory system: nodes 810-840 can directly access available data in external memory 23 or node 850.

While objects of the present invention have been described in detail, one skilled in the art will understand that the specific embodiments as shown in the schematics and descriptions above are subject to change without departure from such functional and structural principles. Therefore, it is intended that the present invention cover the modifications and variations of this invention provided they come within the spirit and scope of the appended claims and their equivalents.

What is claimed is:

1. A plumbing product flushing system comprising:

a. at least one sensor in or on a plumbing product configured to monitor the optical conditions attributing to light intensities in the bowl/drainage area of a plumbing product;

b. a valve to discharge water in a flush mechanism;

c. a control unit receiving sensor output from said at least one sensor and processing said sensor output for determination of a need to flush the sensor monitored plumbing product in accordance with one of the preinstalled flush procedures, said flush procedures including selected variations in quantities of flush water;

d. a lens for protecting said sensor from plumbing product fluid; and e. a nozzle for emitting jet water to cleanse said lens.

2. The flushing system as described in claim 1 wherein the plumbing product is selected from urinals and toilets.

3. The flushing system as described in claim 1 wherein the sensor comprising:

a. a camera having a charge coupled device, or b. a light intensity sensor.

4. The flushing system as described in claim 3 further comprising a network management system connected to the control unit, the network management system processing and evaluating said sensor received information pertaining to light intensities in the bowl/drainage area of said sensor monitored plumbing product and calculating a water quantity for further flushing.

5. The flushing system as described in claim 4 wherein the network management system is configured to store, retrieve and send data related to selected flush procedures and flush mechanism performance assessments based on flush water quantities and water supply pressure; and monitor operation of the flushing system and communicate with control units via a communicative network to receive flushing system operativity and receive information from said control units via said network.

6. The flushing system as claimed in claim 1 further comprising a manual override to override automatic flushing.

7. The flushing system as claimed in claim 1 further comprising said control unit detecting an overflow during a flush and sending an alert.

8. A method of automatic flushing comprising:

a. detecting light intensities in a plumbing product bowl/drainage area using a sensor, selecting and storing related data as reference;

b. detecting real-time light intensities using said sensor and comparing related data against the reference;

c. determining a need for a flush;

d. selecting a particular flush procedure from preinstalled flush procedures; and e. activating a flush mechanism through actuating a valve to discharge the selected quantity of flush water in accordance with the selected flush procedure to flush the plumbing product;

f. detecting light intensities using said sensor following a flush; and g. determining whether one or more activations of subsequent flush are required on the basis of detecting light intensities subsequent to activation of a flush.

9. A method of automatic flushing according to claim 8 further comprising determining a timing to activate a flush mechanism in accordance with light loss and light redemption in the bowl/drainage area of a sensor monitored plumbing product.

10. A method of automatic flushing according to claim 8 where different preinstalled flush procedures use different quantities of water.

11. A method of automatic flushing according to claim 8 further comprising sending data to one or more of control units from an external source via the network.

12. A method of automatic flushing according to claim 11 wherein said control unit receives information from an external source via the network to switch between a power reduce mode and an operation mode to conserve power.

13. A method of automatic flushing according to claim 8 further comprising recording duration and frequency of use of a plumbing product on the basis of detecting light loss and light redemption in the bowl/drainage area of the sensor monitored plumbing product.

14. A method of automatic flushing according to claim 8 further comprising detecting an overflow and sending an overflow alert via the control network.

15. A method of automatic flushing according to claim 11 wherein said control unit sends information relating to the flushing system operativity to one or more communications devices via the network.

16. A method of automatic flushing according to claim 13 further comprising sending an alert to one or more devices via the network.

17. A method of automatic flushing according to claim 8 wherein further comprising self-diagnosing a flushing system operativity and reporting an operation status along with location of said flushing system to other devices via a network.

18. A method of automatic flushing according to claim 14 further comprising automatically shutting off a water supply in response to a detection of an overflow condition.

19. The flushing system as described in claim 1 further comprising a connection to other flushing systems and servers via a network linkage, said network linkage including the internet, intranet and LAN, wherein said connection is for transporting data between a plurality of flushing systems or at least one server, as well as, uploading and downloading of flush procedures, algorithms, software and specifications.

* * * * *